US005113676A

United States Patent [19]

Panossian

[11] Patent Number: 5,113,676

[45] Date of Patent: May 19, 1992

[54] DOUBLE ACTING DEAD LATCH MECHANISM

[76] Inventor: Misak Panossian, 421 E. Lorraine St., Glendale, Calif. 91207

[21] Appl. No.: 636,434

[22] Filed: Dec. 31, 1990

[51] Int. Cl.[5] ..... E05B 15/10

[52] U.S. Cl. ..... 70/418; 70/462; 292/18; 292/192

[58] Field of Search ..... 70/134, 127, 144, 418, 70/419, 451, 462; 292/18, 78, 191, 192, 169.13, 169.17

[56] References Cited

U.S. PATENT DOCUMENTS

| | | | |
|---|---|---|---|
| 19,628 | 3/1858 | Denney . | |
| 23,113 | 3/1859 | Powers . | |
| 583,222 | 5/1897 | Bartl . | |
| 698,811 | 4/1902 | Carleton . | |
| 1,195,713 | 8/1916 | Page . | |
| 1,215,992 | 2/1917 | Rein | 292/192 X |
| 1,223,110 | 4/1917 | Rein et al. | 70/462 X |
| 1,229,335 | 6/1917 | Shaw . | |
| 1,239,188 | 9/1917 | Kohlberger . | |
| 1,250,996 | 12/1917 | Eldridge . | |
| 1,275,938 | 8/1918 | Juselius . | |
| 1,512,986 | 10/1924 | Hurd | 70/418 X |
| 1,514,528 | 11/1924 | Hurd | 292/192 |
| 1,706,486 | 3/1929 | Gasey | 292/169.15 X |
| 1,774,682 | 9/1930 | Van Dooren . | |
| 1,794,055 | 2/1931 | Benson . | |
| 2,098,189 | 11/1937 | Kistner . | |
| 2,107,299 | 2/1938 | Kilpatrick . | |
| 2,218,685 | 10/1940 | Ross . | |
| 2,350,306 | 5/1944 | Spain . | |
| 2,407,775 | 9/1946 | Frost . | |
| 2,503,192 | 4/1950 | Cerf, Jr. . | |
| 2,696,398 | 12/1954 | Teetor | 292/192 X |
| 2,730,391 | 1/1956 | Rayburn . | |
| 2,814,196 | 11/1957 | Frank . | |
| 3,073,143 | 1/1963 | Eads . | |
| 3,492,038 | 1/1970 | Schlage et al. | 292/192 X |
| 4,248,068 | 2/1981 | Esser et al. | 70/418 X |
| 4,248,452 | 2/1981 | Allenbaugh | 70/418 X |
| 4,848,118 | 7/1989 | Tesone . | |
| 4,902,053 | 2/1990 | Hakkarainen et al. | 292/192 X |
| 4,988,133 | 1/1991 | Shih | 292/192 X |

FOREIGN PATENT DOCUMENTS

| | | |
|---|---|---|
| 1143747 | 2/1969 | United Kingdom . |
| 1572366 | 7/1980 | United Kingdom . |

*Primary Examiner*—Renee S. Luebke
*Assistant Examiner*—Suzanne L. Dino

[57] ABSTRACT

A lock mechanism comprising a casing; a bolt housing and two latch bolts carried by the housing to be individually rotatable about vertical axes in response to engagement with a strikeplate; the bolt housing and latch bolts movable as a unit horizontally forwardly and rearwardly within and relatively to the casing; one latch bolt having a shoulder engageable with one surface on the casing in response to the rotation of the one latch bolt in a clockwise direction to displace the housing and the two latch bolts as a unit horizontally rearwardly by a first increment relative to the casing, whereby the two latch bolts are then positioned to be further engaged in camming relation by the strikeplate, traveling relatively in a first direction to displace both latch bolts and the housing horizontally rearwardly by a second increment relative to the casing.

9 Claims, 6 Drawing Sheets

120
46
72
70
42
44
90
118a
50
86
64
116
154b
66
38
78a
58
154
96
154c
114
39
54
92
112
118b
110
98
108
52
56
48
106
44

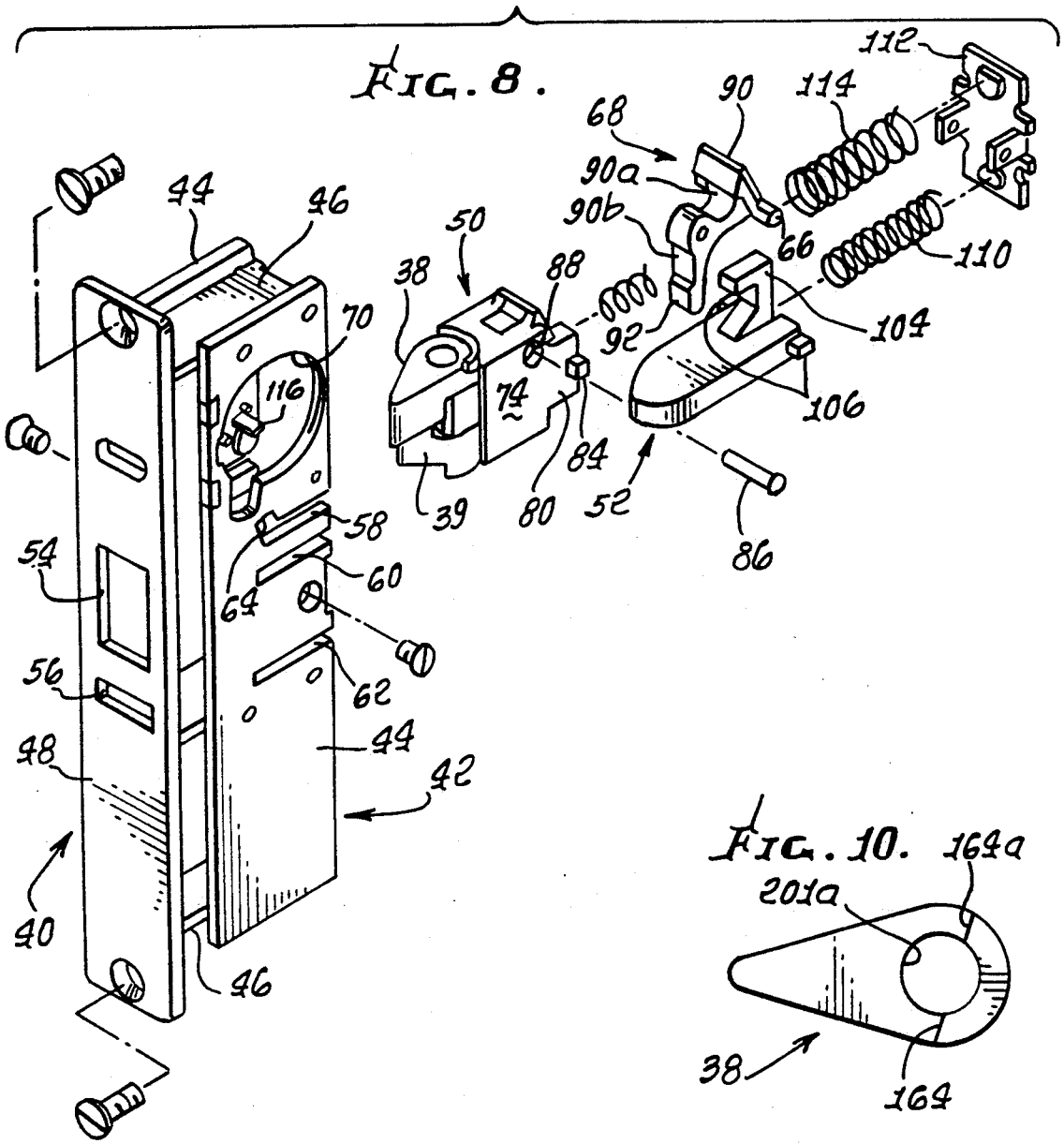
FIG. 8.
112
114
90
68
90a
90b
66
110
44
46
50
38
88
70
92
104
116
74
106
84
39
80
52
86
58
54
60
64
56
62
44
48
42
40
46
FIG. 10.
164a
201a
38
164
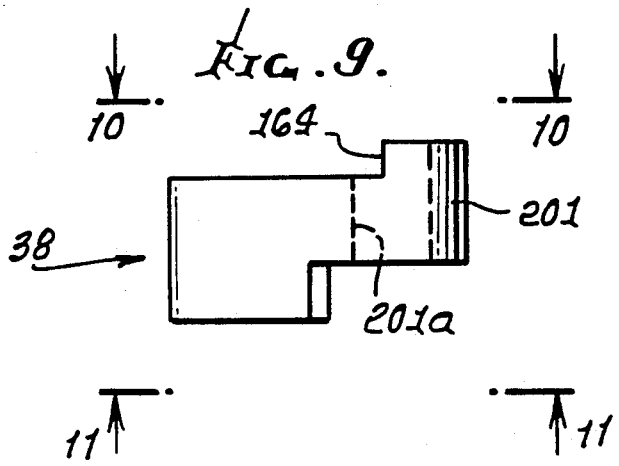
FIG. 9.
10
164
10
201
38
201a
11
11
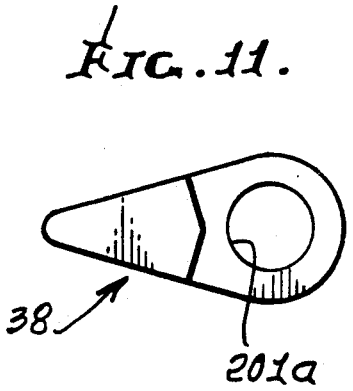
FIG. 11.
38
201a

DOUBLE ACTING DEAD LATCH MECHANISM

BACKGROUND OF THE INVENTION

This invention relates generally to lock mechanisms, and more particularly to a door lock wherein a strikeplate retains a latch bolt in latched, deadlock position, in such manner that the door may be pushed open from either side.

U.S. Pat. No. 4,848,118 describes an improved, latched, deadlock bolt mechanism of anti-pick type; however, the door carrying that mechanism can only be opened from one side. There is need for further improvements enabling the door to be pushed open from either side.

SUMMARY OF THE INVENTION

It is a major object of the invention to provide structure meeting the above need. Basically, the lock mechanism of the invention comprises, in combination:

a) a casing, b) a bolt housing and two latch bolts carried by the housing to be individually rotatable about vertical axes in response to engagement with a strikeplate, c) the bolt housing and latch bolts movable as a unit horizontally forwardly and rearwardly within and relative to the casing, d) one latch bolt having a shoulder engageable with one surface on the casing in response to the rotation of the one latch bolt in a clockwise direction to displace the housing and the two latch bolts as a unit horizontally rearwardly by a first increment relative to the casing, by the two latch bolts then being positioned to be further engaged in camming relation by the strikeplate, to displace both latch bolts and the housing horizontally rearwardly by a second increment relative to the casing.

As will be seen, the other latch bolt may have a shoulder engageable with another surface on the casing in response to the rotation of the other latch bolt in a counterclockwise direction, thereby to displace the housing and the two latch bolts as a unit horizontally rearwardly by a third increment relative to the casing, whereby the two latch bolts are then positioned to be further engaged in camming relation by the strikeplate traveling relatively in a second direction, to displace both latch bolts and the housing horizontally rearwardly by a fourth increment relative to the casing.

Such a mechanism is usable, for example, on double acting, smoke barrier single doors in facilities such a hospitals and nursing homes where corridors are too narrow for double egress doors and compartmentalization in case of fire would aid in saving lives. The single door would normally be held open by a wall-mounted magnet and released on command of the emergency alarm system. A double-acting closer would close the door and the latch bolt would stop the movement by contacting a jam-mounted strike. Then the door could be pushed open from either side as by push bars and would return to the neutral latched, deadlock position sealing off the safe compartment from the unsafe.

Yet another object is to provide the two latch bolts with a common vertical axis of rotation, one latch bolt being vertically offset relative to the other.

It is another object of the invention to provide for both first and third increments to be equal, and in the same rearward direction; the second and fourth increments also typically being equal and in the same rearward direction. In this regard, a rectangular three-axis coordinate system is typically defined by the vertical direction, the rearward direction, and the first direction referred to.

A further object is to provide mechanism, as described in a structure wherein the two latch bolts have camming end portions that protrude through an opening on a faceplate and are movable between extended and retracted positions the structure including a locking member mounted for pivotal movement within the casing, the locking member having a first arm extending outwardly and adapted to engage a key-controlled element for moving the locking member between locked and unlocked positions, and a second arm extending outwardly and adapted to engage a deadlock actuator, the deadlock actuator movable within the casing between extended and retracted positions and in the extended position engaging the locking member, the locking member latch bolt, and deadlock actuator having pin means extending laterally into guide slots in the casing.

Typically, the bolt member includes barrier wall means forward of the guide slot that serve to prevent a shim-type lockpick device being inserted through the opening in the faceplate and along the casing to force the locking member to disengage.

These and other objects and advantages of the invention, as well as the details of an illustrative embodiment, will be more fully understood from the following specification and drawings, in which:

DRAWING DESCRIPTION

Figure 3A:
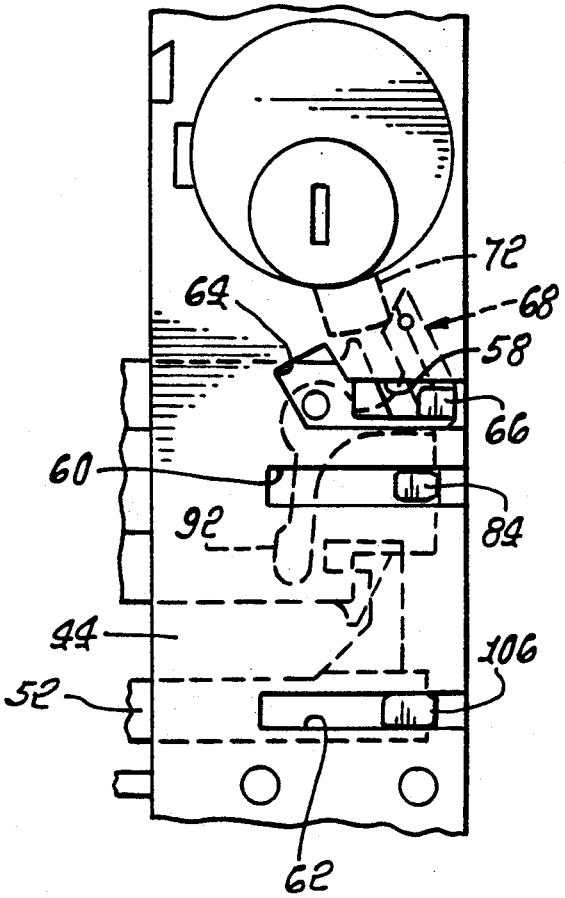
FIG. 3 is a view like FIG. 2 but showing the bolt and deadlock actuator in retracted position.
Figure 12:
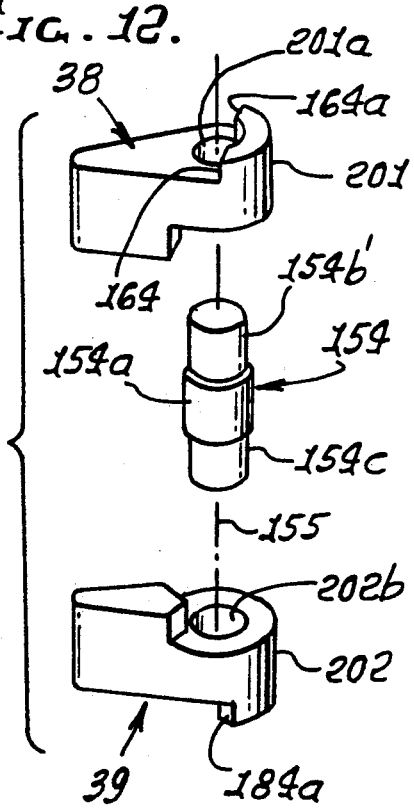
Figure 13:
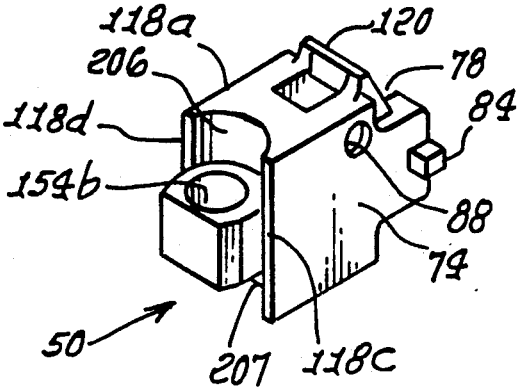
Figure 2:
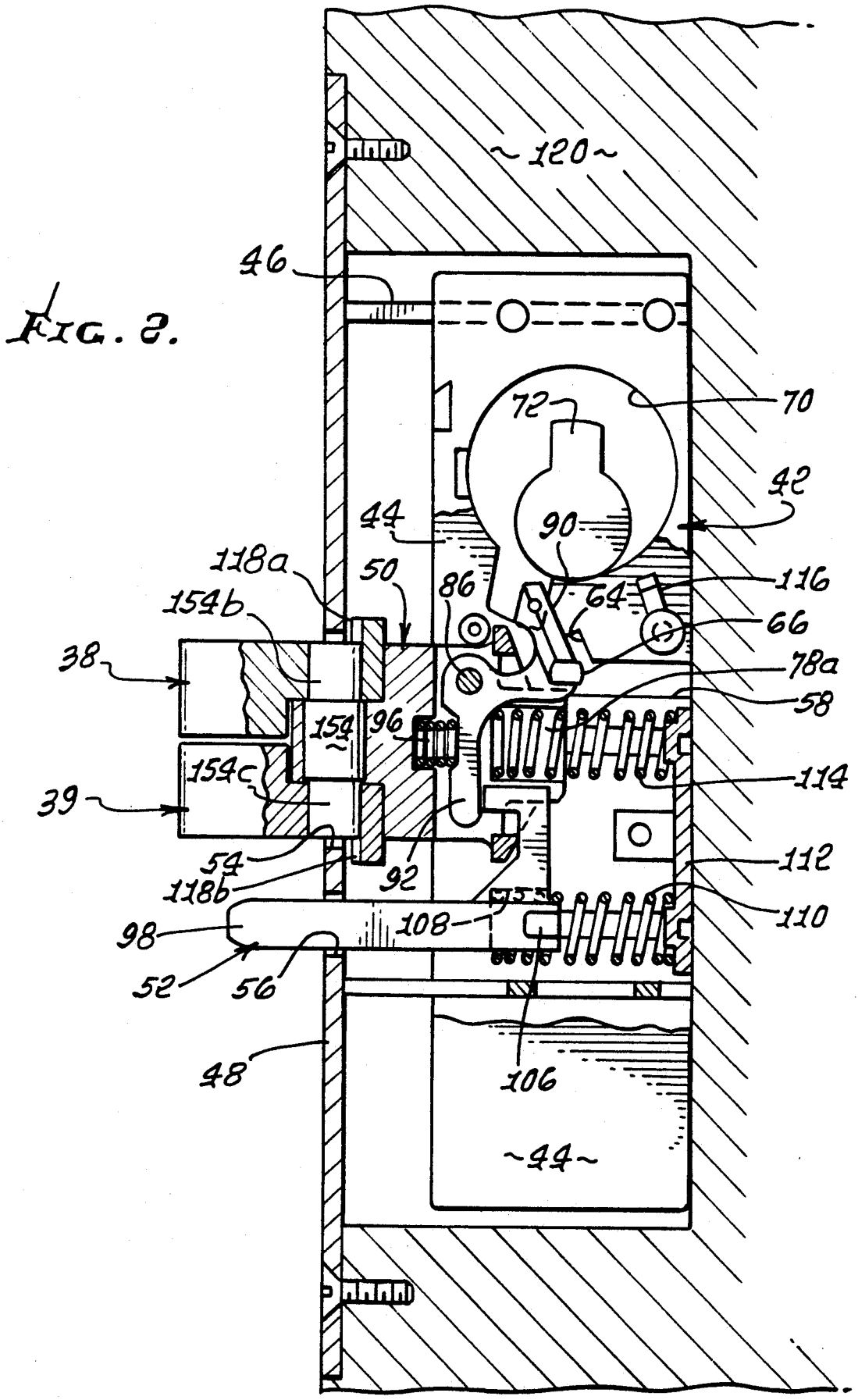
FIG. 2 is a side elevational view of the latch of the present invention, with sections broken away, showing the bolt and deadlock actuator in extended positions.
Figure 3:
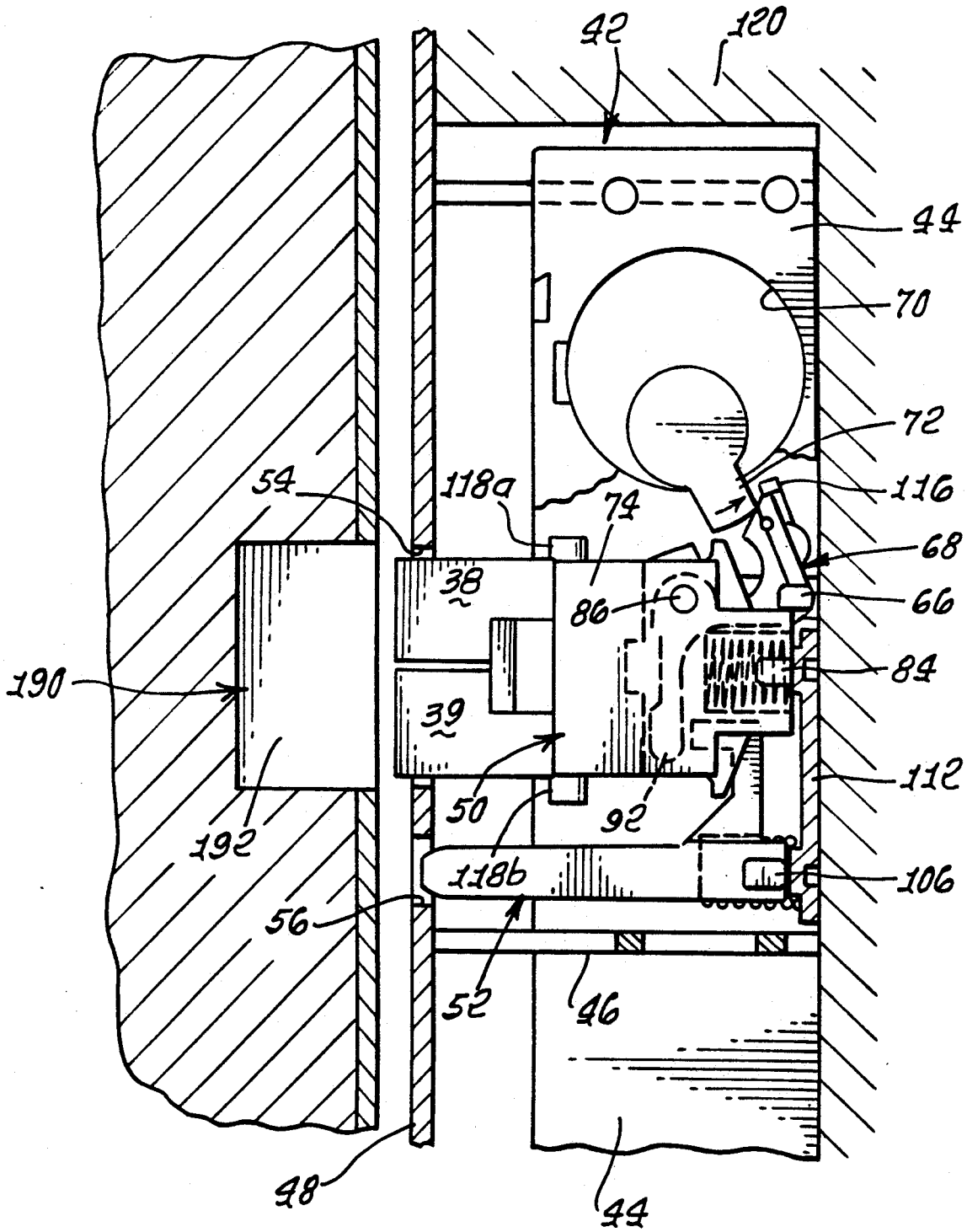
Figure 4:
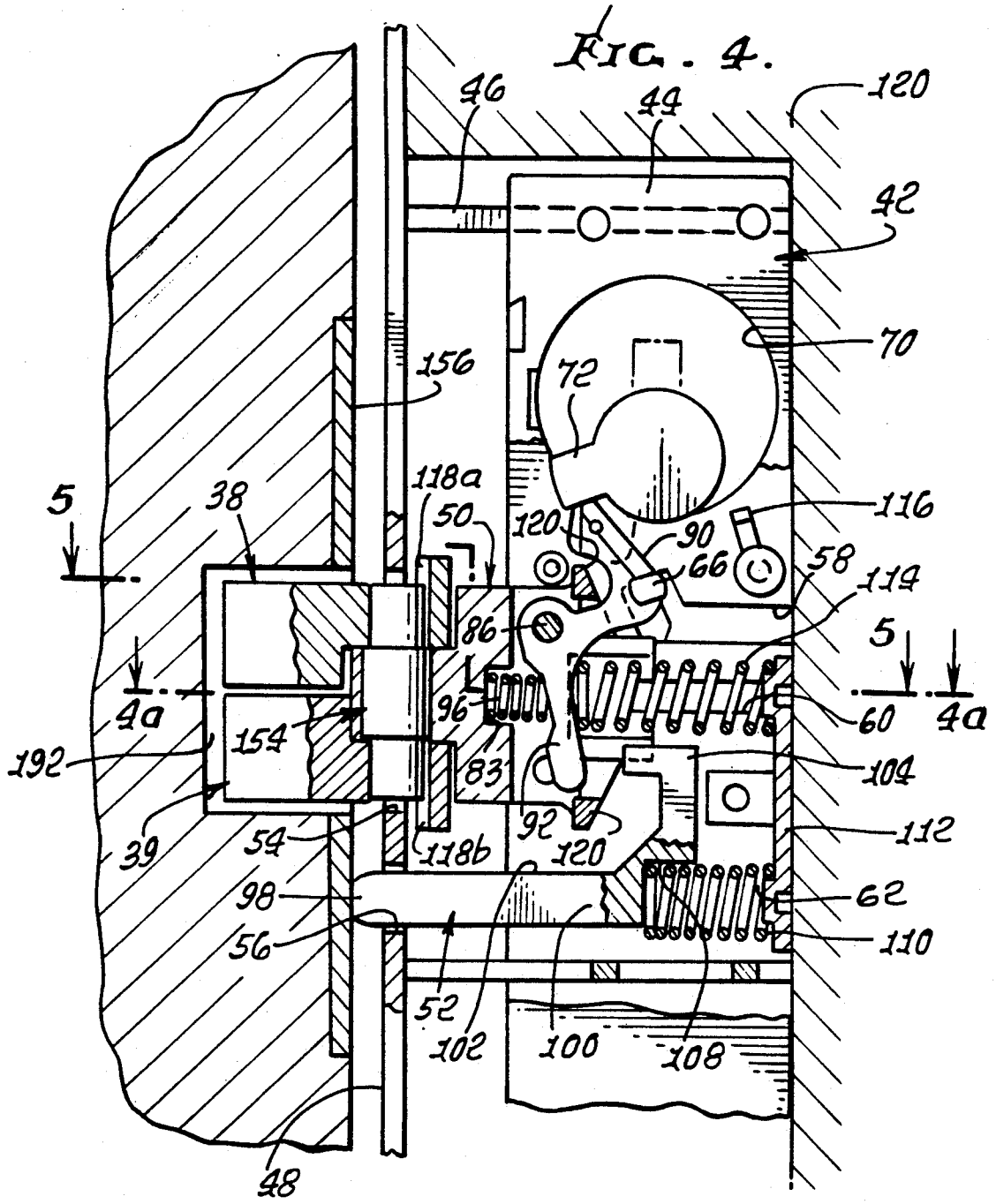
Figure 4A:
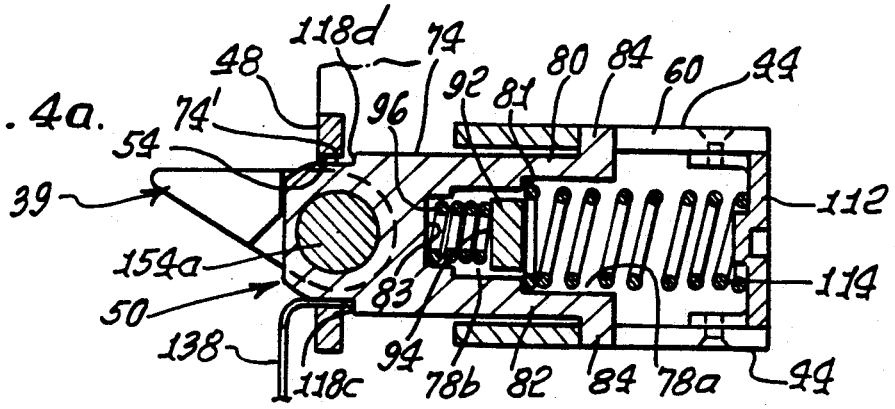
Figure 5:
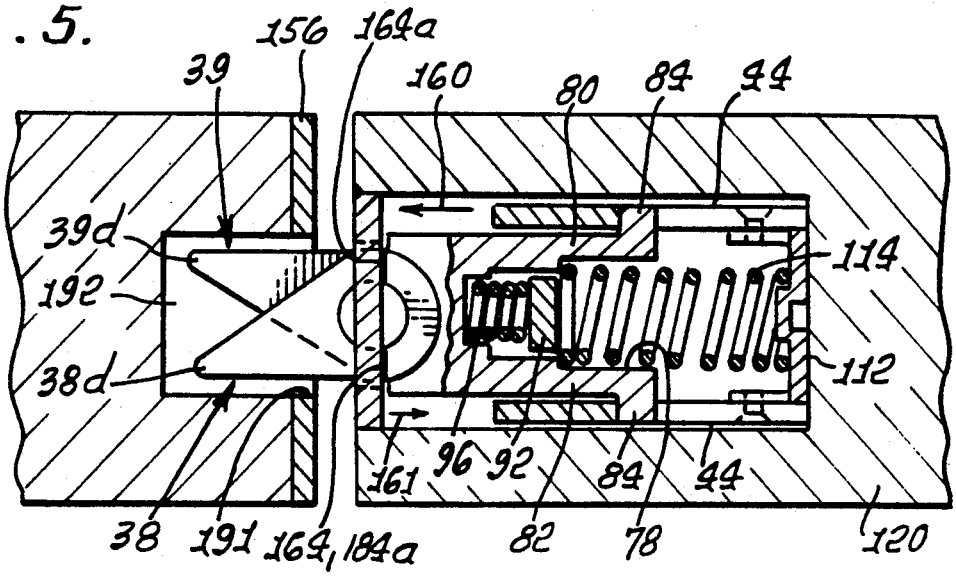
Figure 6:
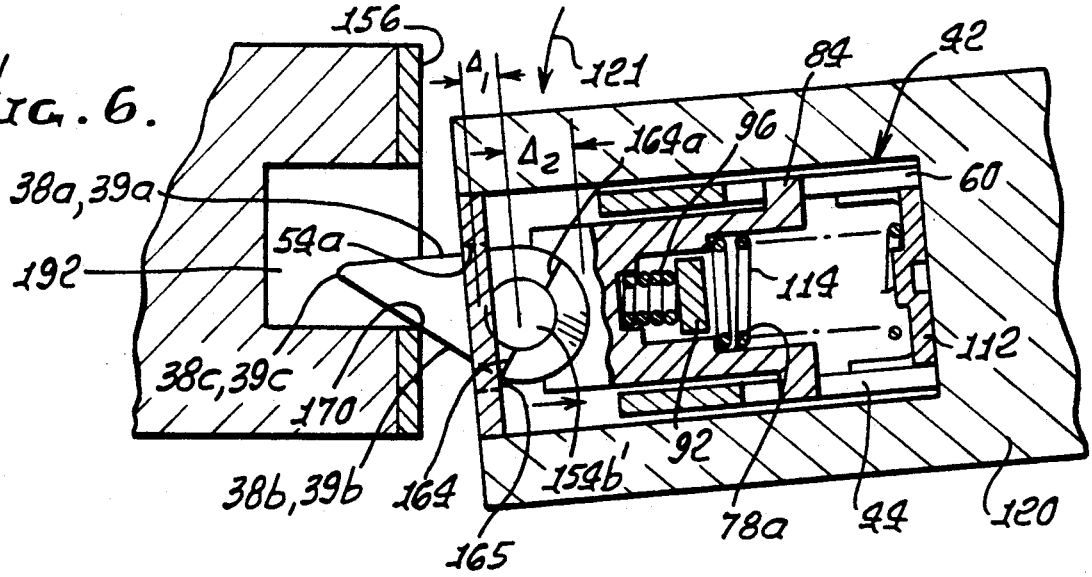
Figure 7:
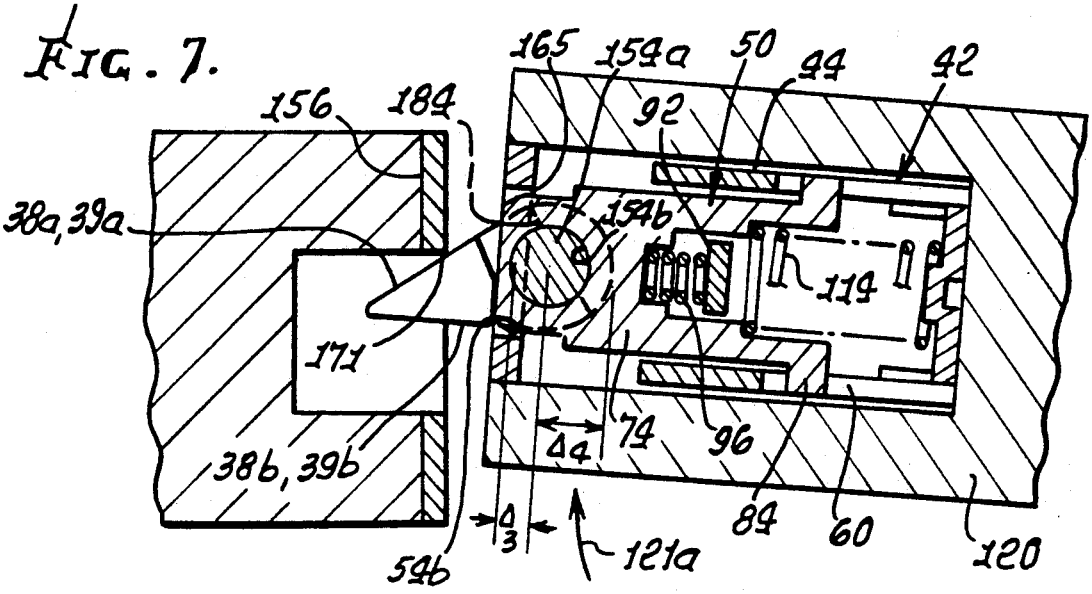

FIG. 3*a* is a view like FIG. 3 but taken from the outer side of the mechanism;

FIG. 4 is a view like FIG. 2 showing the bolt and deadlock actuator in extended position, and in relation to a strikeplate;

FIG. 4*a* is a section taken on lines 4*a*—4*a* of FIG. 4;

FIG. 5 is a section taken on lines 5—5 of FIG. 4;

FIG. 6 is a view like FIG. 5 showing the door being opened in one direction, and showing one latch bolt pivoted into a vertical alignment with the other latch bolt;

FIG. 7 is a view like FIG. 5 but showing the door being opened in the opposite direction, the other latch bolt pivoted into vertical alignment with the one latch bolt;

FIG. 8 is an exploded perspective view showing the improved deadlatch of the present invention;

FIG. 9 is a side elevational view of the upper bolt member seen in FIG. 12;

FIG. 10 is a top plan view of the FIG. 9 bolt member;

FIG. 11 is a bottom plan view of the FIG. 9 bolt member;

FIG. 12 is a vertically exploded, perspective view of the upper and lower bolt members and pin about which they are pivotable; and FIG. 13 is a perspective view showing bolt member and pin mounting means.

DETAILED DESCRIPTION

Reference will first be made to FIGS. 3, 4 and 8 herein showing certain structure corresponding to FIGS. 1–10 of U.S. Pat. No. 4,848,118 incorporated by reference herein, and describing an anti-pick lock mechanism into which the present invention may be incorporated.

Lock mechanism 40 includes a casing 42 having a pair of side plates 44 separated by brackets 46. A faceplate 48 is secured to the brackets 46 to provide the generally box-like casing 42 which receives two latch bolts 38 and 39 and deadlock actuator 52. The bolts 38 and 39 and actuator 52, respectively, project through rectangular openings 54 and 56 in the faceplate 48. The side plates each include guide slots 58, 60, and 62. The guide slot 58 has a notch 64 at one end for receiving the laterally extending pin 66 of a locking element 68. At the upper ends of the side plates 44 is a generally circular opening 70 into which the key-controlled cam 72 is housed. This key controlled cam 72 is used to move the locking element 68 between locked and unlocked positions in response to the turning of a key (not shown).

As best shown in FIG. 13, the bolt structure 50 includes a body member 74 to carry the two bolts 38 and 39 so that they project through the opening 54. See FIG. 7. The rear section of the body member 74 has a recess 78 therein formed by two rearwardly projecting walls 80 and 82. A pair of laterally projecting pins 84 extend oppositely outwardly from these walls into the guide slots 60 in the side plates 44. As best shown in FIG. 4*a*, the recess 78 has two offset sections 78*a* and 78*b* to provide a ledge 81. At the rear wall of recess section 78*b* is a central bore 83. The locking element 68 is received within the recess 78 between the walls 80 and 82 and is pivotally mounted to the body member 74 by a rod 86 (FIG. 4) which extends through aligned holes 88 in the body member.

The locking element 68 has two outwardly projecting arms 90 and 92. Arm 90 has a generally L-shaped configuration with the two outwardly projecting pins 66 extending laterally at the intersection between the legs 90*a* and 90*b*. Arm 92 extends into recess section 78 (see FIG. 4*a*), and it has an offset 94 therein which receives a coiled compression spring 96 that will normally bias the locking element 68 in a counterclockwise direction as viewed in FIG. 4. The spring 96 is seated in the bore 83.

The deadlock actuator 52 includes a camming end 98 which projects through the rectangular opening 56 in the faceplate 48, and a rear body section 100 including a generally flat top 102 having a centrally located hooked finger 104 projecting upwardly from the top, and a pair of opposed pins 106 extending laterally from the side of the actuator. A central cavity 108 in the rear body section 100 receives a coiled spring 110. This spring 110 forces the actuator 52 into the extended position shown in FIG. 2.

As best shown in FIGS. 2, 3, and 8, the actuator 52 and locking element 68 are held in position by retaining plate 112 carried by the casing 42. A coiled compression spring 114, seated partially in recess section 78*a*, normally presses against the exterior of the arm 92 to force the locking element 68 to rotate in a clockwise direction as viewed in FIG. 2. The retaining plate 112 is removably secured to the side plates 44 to hold the coiled springs 110 and 114 in position as shown in FIG. 2. With the deadlock actuator 52 in the extended position, the hooked finger 104 engages the arm 92, rotating the locking element 68 in a clockwise direction 4 to move the pins 66 from the notch 64. With the deadlock actuator 52 moved to the retracted position upon closure of the door, as viewed in FIG. 4, the locking element 68 is rotated in a counterclockwise direction under the force of the spring 96 to move the pins 66 into the notch 64 to lock the bolts 38 and 39 into position. The bolts can move inwardly when the locking element 68 is unlocked by turning the key-controlled cam 72 in a counterclockwise direction as viewed by FIG. 3. Rotating the cam 72 in a clockwise direction, as viewed in FIG. 3, will bring the cam into engagement with a retainer element 116 to hold the end of the locking element 68 in retained position.

The bolt body 74 includes barrier walls 118*a* through 118*d* on each of its four sides (see FIG. 4*a*) to prevent the shim-type pick 138 from being inserted through the opening 54 between the bolt structure 50 and the faceplate 48 and side plates 44. The walls 118*a* and 118*b* are provided by a pair of opposed wedge shaped members 120 which are integral with the bolt 50. The leg of the arm 90*a* is sufficiently long to extend up and over the top barrier wall 118*a*, as shown in FIG. 4, so that it may engage the cam 72 of the key controlled lock. The forward end of the bolt body 74 is offset inwardly slightly to provide two side barrier walls 118*c* and 118*d*. These barrier walls 118*a* through 118*d* are all forward of the pin elements 66, 84, and 106 of the locking element 68, bolt structure 50 and deadlock actuator 52, respectively. Consequently, the shim 138, which has a thickness approximately equal to or less than the barrier walls 118*a* through 118*d*, ordinarily 1/64 inch, will not slip past these walls. By carefully controlling the dimensions of the opening 54 and bolt structure 50 so that there is a tight fit between the bolt body forward end 74' and the opening, only a very thin shim will pass through this space between the opening and bolt body forward end. Thus, the thin shim 138 will then engage a barrier wall 118*a* through 118*d*, which is about as thick or thicker than the shim, preventing the shim from picking the locking mechanism 40.

Referring to FIGS. 5–13, the improved lock mechanism has to do with improving the bolt structure, as referred to above. As shown, four elements, 38, 39, 50, and 154, are substituted for the bolt seen in prior U.S. Pat. No. 4,848,118. These include bolt body or housing 74, the two latch bolts 38 and 39, carried by the housing to be rotatable about vertical axe (such as a common vertical axis 155) in response to bolt engagement with a strikeplate as at 156 in FIG. 4) and pin means, such as a single vertically extending pin 154 about which both latch bolts are rotatable. Pin 154 has a mid-portion 154*a* received in a bore 154*b* in housing 74. The bolt housing 74, latch bolts 38 and 39 and pin 154 are movable as a unit horizontally forward (see arrow 160) and rearwardly (see arrow 161) within and relative to the casing, as seen in FIG. 5. The vertical direction (see axis 155), the later referenced "first opening" direction 121, and the rearward direction 161 define a three axis, rectangular coordinate system.

More specifically, one latch bolt, such as upper bolt 38, has a shoulder 164 engageable with the surface 165 on the casing in response to rotation of that bolt 38 in a clockwise direction (caused by swinging of the door 120 in a first opening direction 121 in FIG. 6) to displace the housing 74 and the two latch bolts 38 and 39 as unit horizontally rearwardly by a first increment $\Delta_1$ relative to the casing 42, whereby the two tapered latch bolts 38 and 39 are then superposed or positioned to be further engaged at 170 in camming relation by the strikeplate. See FIG. 6 showing the edges 38*a* and 39*a* of both bolts engaging the "stop" edge 54*a* of opening 54. The strikeplate then engages or cams against sloping edges 38*b* and 39*b* of both bolts as the door travels or swings in direction 121, to displace both latch bolts and the housing horizontally rearwardly by a second increment relative to the casing. That increment $\Delta_2$ is the amount by which the bolt tips at 38*c* and 39*c* must move rearwardly to clear edge 170.

Likewise, the other latch bolt, as at 39, has a shoulder 184 engageable with the surface 165 on the casing in response to rotation of that bolt 39 in a counterclockwise direction (caused by swinging of door 120 in the reverse opening direction 121*a* in FIG. 7), to displace the housing 74 and the two latch bolts 38 and 39 as a unit horizontally rearwardly by a third increment $\Delta_3$, relative to the casing 42, whereby the two tapered latch bolts 38 and 39 are then superposed or positioned to be further engaged at 171 in camming relation by the strikeplate. See FIG. 7 showing the edges 38*b* and 39*b* of both bolts engaging the "stop" edge 54*b* of opening 54. The strikeplate then engages or cams against sloping edges 38*a* and 39*a* of both bolts, as the door travels or swings in direction 121*a*, to displace both latch bolts and the housing 74 horizontally rearwardly by a fourth increment $\Delta_4$ relative to the casing. As before $\Delta_4$ is the amount that the bolt tips must move rearwardly to clear edge 171. In general, $\Delta_2$ and $\Delta_4$ are equal, and $\Delta_1$ and $\Delta_3$ are equal.

In the above, it will be noted that shoulders 164 and 184 define fulcrums.

It will be noted in FIGS. 6 and 7 that the spring 114 urges the housing 74 forwardly to cause shoulders 164 and 184 to press against the surface 165, as referred to.

FIG. 5 shows the two bolts 38 and 39 in partly superposed condition or relation prior to door and casing swinging in either direction 121 or 121*a*. Note the bolt forward tapered extents 38*d* and 39*d* received in the keeper recess 190 formed by the strikeplate opening 191 and by the jam opening 192. Bolt edges 164 and 164*a* engage the surface 165, as do bolt edges 184 and 184*a*, stabilizing the bolts in the positions shown, with their tips offset as shown, and spring 114 yieldably holding the bolts in such positions.

Figure 1:
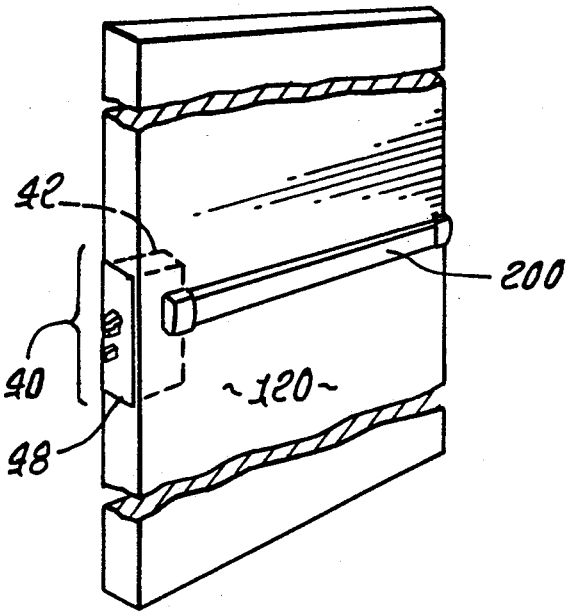
FIG. 1 is a perspective view showing a door to which the lock mechanism of the invention is applicable.

FIG. 1 shows a door 120 carrying the lock mechanism 40, as referred to. A panic bar may be carried by the door, as at 200.

FIG. 9–11 show one of the bolts, as for example bolt 38, having an enlarged hub 201 forming a bore 201*a* to rotatably receive the pin 154 upper extent 154*b*'. Pin lower extent 154*c* is received by the lower bolt 39 bore 202*b*. Shoulders 164 and 164*a* are on an upper, semi-circular extension 201*b* of hub 201; and shoulders 184 and 184*a* are on a lower, semi-circular extension 202*a* of hub 202. See FIG. 12. Semi-circular recesses 206 and 207 in housing 74 receive the enlarged bolt hubs. See FIG. 13.

I claim:

1. A lock mechanism comprising, in combination:

a) a casing, b) a bolt housing and two latch bolts carried by the housing to be individually rotatable about a common vertical axis in response to engagement with a strikeplate, one latch bolt vertically offset relative to the other, and pin means carried by the housing and receivable in openings in said latch bolts, whereby the latch bolts are rotatable about the pin means, the pin means defining said vertical axis, c) the bolt housing and latch bolts movable as a unit horizontally forwardly and rearwardly within and relative to the casing.

d) one latch bolt having a shoulder engageable with one surface on the casing in response to said rotation of said one latch bolt in a clockwise direction to displace the housing and the two latch bolts as a unit horizontally rearwardly by a first increment relative to the casing, whereby the two latch bolts are then positioned to be further engaged in camming relation by the strikeplate, traveling relatively in a first direction to displace both latch bolts and the housing horizontally rearwardly by a second increment relative to the casing, the other latch bolt having a shoulder engageable with another surface on the casing in response to said rotation of the other latch bolt in a counterclockwise direction, thereby to displace the housing and the two latch bolts as a unit horizontally rearwardly by a third increment relative to the casing, whereby the two latch bolts are then positioned to be further engaged in camming relation by the strikeplate, traveling relatively in a second direction, to displace both latch bolts and the housing horizontally rearwardly by a fourth increment relative to the casing, e) said bolts having enlarged hubs forming said pin receiving openings, said latch bolts having hub extensions forming said shoulders, which define fulcrums, said extensions projecting axially oppositely.

2. The combination of claim 1 wherein said first and second relative travel directions of the bolts relative to the strikeplate are opposite directions.

3. The combination of claim 1 wherein said first and third increments are equal and in the same rearward direction.

4. The combination of claim 1 wherein said second and fourth increments are equal, and in the same rearward direction.

5. The combination of claim 1 wherein said vertical direction, said first direction and said rearward direction define a rectangular three axis coordinate system.

6. The combination of claim 1 wherein said hub extensions also form other shoulders, all of said shoulders engaging a surface on the casing to stabilize the positions of the bolts relative to the strikeplate, there being a spring acting to yieldably urge said shoulders against the casing.

7. The combination of claim 6 wherein the casing has a faceplate that forms an opening passing tapered portions of said bolts projecting from said hubs.

8. The combination of claim 7 wherein said housing has four barrier walls on all four sides respectively of the housing that serve to prevent a shim-type lockpick device being inserted along any side through the opening in the faceplate and along the casing.

9. The combination of claim 8 including a deadlock actuator movable horizontally forwardly and rearwardly within the casing below the bolts and between extended and retracted positions, and a rotary locking member carried by the casing for engaging the deadlock actuator, the locking member projecting upwardly rearwardly of the uppermost of said barrier walls, for engagement by a key-controlled element and the deadlock actuator projecting upwardly rearwardly of the lowermost of said barrier walls in order to engage said locking member.

* * * * *